United States Patent [19]

Jessup et al.

[11] Patent Number: 4,602,919

[45] Date of Patent: Jul. 29, 1986

[54] GASOLINE COMPOSITIONS CONTAINING MALONATES

[75] Inventors: Peter J. Jessup, Santa Ana; Stephen G. Brass, Fullerton; Michael C. Croudace, Huntington Beach, all of Calif.

[73] Assignee: Union Oil Company of California, Los Angeles, Calif.

[21] Appl. No.: 728,246

[22] Filed: Apr. 29, 1985

[51] Int. Cl.[4] ..... C10L 1/18

[52] U.S. Cl. ..... 44/70

[58] Field of Search ..... 44/70

[56] References Cited

U.S. PATENT DOCUMENTS 4,217,231 8/1980 King ..... 166/283

FOREIGN PATENT DOCUMENTS 1444431 7/1976 United Kingdom .

*Primary Examiner*—Y. Harris-Smith

*Attorney, Agent, or Firm*—Gregory F. Wirzbicki; Dean Sandford; Michael C. Schiffer

[57] ABSTRACT

A fuel composition containing a malonate as an anti-knock additive.

10 Claims, No Drawings

GASOLINE COMPOSITIONS CONTAINING MALONATES

BACKGROUND OF THE INVENTION

The present invention relates to an anti-knock additive for fuel compositions, primarily gasoline compositions.

The petroleum industry has long recognized a need for greater fuel economy and efficiency in the operation of gasoline powered spark ignition engines. In many instances, high compression ratios are desired in order to provide for superior engine performance under various driving conditions. In order to provide high performance in high compression engines without the risk of knock damage, fuels which will be used in such engines require a high octane number and good anti-knock characteristics.

While octane ratings of fuels can be improved by blending appropriate refining streams, the necessary additional refining and blending operations needed to obtain a fuel having the desired high octane rating are costly. In lieu of these various refining and blending processes the petroleum industry sometimes blends anti-knock additives into fuels to increase the octane number of the fuel. For many refineries the use of anti-knock compounds is essential due to the lack of the refining and blending facilities to produce the high octane fuels.

Numerous compounds have been suggested as anti-knock additives for fuel compositions. The most successful of these anti-knock compounds additives are organo-lead compounds that can be added to fuels as anti-knock additives. The use of organo-lead compounds in gasoline is severely limited by recent legislation and may be completely prohibited in the future. It is desirable to develop other anti-knock additives as replacements for organo-lead compounds.

Numerous non-lead, anti-knock compounds have been suggested, such as rare earth beta-keto-enolate compounds, the lithium and sodium salts of organo-amino-cresols, various other organo metallic compounds, in particular organo-iron and organo-manganese compounds, such as, iron pentacarbonyl and methyl cyclopentadienyl manganese tri-carbonyl. Additionally, it is known that the anti-knock and octane properties of a fuel can be improved by blending alcohol therewith.

These anti-knock additives have their own associated problems when blended into fuels for use in internal combustion engines. The numerous organo-iron compounds increase the potential of wear in internal combustion engines and the organo-manganese compounds may effect the catalytic converters used on most cars today to reduce air pollution for exhaust emissions. Fuel compositions of gasoline and alcohol have many problems, including separation if water is admixed with the composition (due to the gasoline insolubility of many alcohols).

As can be seen, the petroleum industry has a need for gasoline additives, which, while having useful anti-knock properties, do not impart the known disadvantages of organo-metallic compounds and alcohol.

SUMMARY OF THE INVENTION

The present invention resides in a fuel composition having improved anti-knock characteristics comprising a liquid hydrocarbon fuel, particularly gasoline, and an anti-knock enhancing amount of a compound of the following formula:

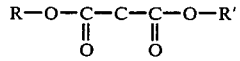

wherein: R and R′ are the same or different $C_1$–$C_{20}$ organic radical, preferably a $C_1$–$C_{10}$ substituted or unsubstituted alkyl or aryl radical, most preferably a $C_1$–$C_{10}$ substituted or unsubstituted alkyl radical.

DESCRIPTION OF THE PREFERRED EMBODIMENTS

The present invention is directed to a composition comprising a major amount of a base fuel and an anti-knock enhancing amount of a compound of formula:

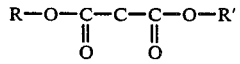

wherein: R and R′ are the same or different $C_1$–$C_{20}$ organic radical, preferably a $C_1$–$C_{10}$ substituted or unsubstituted alkyl or aryl radical, more preferably a $C_1$–$C_3$ unsubstituted alkyl aralkyl, alkenyl, alkynyl, aralkenyl, aralkynyl radical, and most preferably methyl or ethyl radicals.

Additive compounds having the above structure are generally referred to as malonates, such as dipropyl malonate, dibutyl malonate, diphenyl malonate, methyl ethyl malonate, methyl phenyl malonate, diethyl malonate and dimethyl malonate.

Anti-knock characteristics of an additive are typically evidenced by an increase in the motor and research octane numbers of the base fuel when the additive is admixed therewith. The motor (MON) and research (RON) octane numbers of fuel compositions are typically measured by ASTM D 2700 and ASTM D 2699, respectively. While motor and research octane numbers are themselves good indicators of anti-knock characteristics of an additive, another measure of anti-knock characteristics of an additive is the average of the two numbers (RON+MON)/2. This average provides a fairly good approximation of the octane number required by engines under typical driving conditions, in that MON is a more severe test, with higher compression and temperature, than RON. Furthermore, this average is the typical rating used for commercial fuel products.

The fuel composition may be comprised of any amount of the additive compound of this invention which enhances the anti-knock characteristics of the fuel to the level desired by the end user. Usually, the anti-knock additive comprises a minor proportion (i.e., less than 50 volume percent) of the fuel composition. Preferably the fuel composition comprises from about 1 volume percent to about 15 volume percent of the additive compound of this invention, more preferably from about 5 to about 10 volume percent of the additive compound.

Base fuels to which the anti-knock additive compound of this invention may be added to improve the anti-knock properties include all of the volatile liquid fuels known to be suitable for spark-ignition, internal combustion engines. Preferably, the base fuel composition comprises gasoline, e.g., a hydrocarbon liquid having a boiling range from about 130° F. to about 430° F. These base fuels usually comprise straight chain or branch chain paraffins, cycloparaffins, olefins and substituted or unsubstituted aromatic hydrocarbons or any mixture of these. This fuel can be derived from straight-run naphtha, alkylate gasoline, polymer gasoline, natural gasoline, isomerized and/or hydrotreated stocks, catalytically cracked or thermally cracked hydrocarbons, catalytically reformed stocks and synthetic hydrocarbons stocks derived from the various solid carbonaceous materials, e.g. coal or oil shale. In general, any conventional, substantially hydrocarbon motor fuel base may be employed in the practice of this invention.

The base fuel may contain other additives normally employed in fuels, e.g., anti-icing agents, detergents, demulsifiers, corrosion inhibitors, dyes, deposit modifiers, anti-knock multi-purpose additives and the like. However, since this invention relates to anti-knock compounds useful for admixture into base fuels, the base fuel used will preferably be essentially free of other anti-knock compounds, particularly the organo-metallic compounds, e.g., organo-lead and organo-manganese compounds, and other anti-knock compounds used in base fuels, specifically, alcohols such as methanol. Thus the preferred composition of this invention comprises a major portion of a base fuel and an anti-knock enhancing amount of the compound of this invention, with the composition being essentially free of compounds such as organo-lead compounds and organo-manganese compounds and completely free of alcohol. By "essentially free of" it is meant that the composition will comprise less than 0.05 grams/gallon of organo-lead and organo-manganese compounds, independently.

The following examples serve to further illustrate the invention and are not intended to be construed as limiting thereof.

EXAMPLES 1–8

The following Examples 1–8 illustrate the invention. Anti-knock additives of this invention were blended into a base fuel at the levels indicated in Table 1. The base fuel was a gasoline containing 33.5 volume percent aromatics, 7.5 volume percent olefins and 59 volume percent saturants having an A.P.I. gravity of 58.4, vapor pressure of 8.6, a sulfur content of 296 ppm, and less than about 0.05 grams/gallon lead. Also indicated in Table 1 are the organic radicals of each anti-knock additive and the respective RON, MON and (RON+MON)/2 numbers. As can be seen, the anti-knock additives of this invention generally increased the RON, MON and (RON+MON)/2 over the values for the base fuel.

TABLE 1

| Example No. | R | R' | Vol. % In Fuel | RON | MON | (R + M)/2 |
|---|---|---|---|---|---|---|
| 1 | Methyl | Methyl | 1 | 94.5 | 104.4 | 99.45 |
| 2 | Methyl | Methyl | 5 | 116.5 | — | — |
| 3 | Ethyl | Ethyl | 1 | 84.5 | 64.4 | 74.45 |
| 4 | Ethyl | Ethyl | 5 | 114.5 | 98.4 | 106.45 |
| 5 | Methyl | Methyl | 1 | 124.4 | 79.4 | 102 |
| 6 | Methyl | t-Butyl | 5 | 100.5 | 70.4 | 85.45 |
| 7 | n-Butyl | n-Butyl | 1 | 84.5 | 84.4 | 84.45 |

TABLE 1-continued

| Example No. | R | R' | Vol. % In Fuel | RON | MON | (R + M)/2 |
|---|---|---|---|---|---|---|
| 8 | n-Butyl | n-Butyl | 5 | 94.5 | 84.4 | 89.45 |
| Base Fuel | — | — | — | 94.4 | 84.1 | 89.25 |

While the preferred embodiments have been described and illustrated, various modifications and substitutions may be made thereto without departing from the spirit and the scope of the present invention. Accordingly, the invention has been described by way of illustration and not limitation, and thus no limitation should be imposed other than those as indicated in the following claims.

We claim:

1. A composition comprising a major amount of a liquid hydrocarbon base fuel and an anti-knock enhancing amount of the compound of the formula:

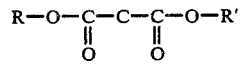

wherein R and R' are the same or different $C_1$ to $C_{10}$ substituted or unsubstituted alkyl, alkenyl or alkynyl radical.

2. The composition of claim 1 wherein R and R' are the same or different $C_1$ to $C_{10}$ alkyl radical.

3. The composition of claims 1, or 3 wherein the compound comprises from about 5 to about 10 volume percent of said composition.

4. The composition of claim 3 wherein said base fuel is gasoline.

5. The composition of claim 3 wherein said composition is essentially free of organo-lead compounds.

6. The composition of claim 3 wherein said composition is essentially free of organo-manganese compounds.

7. The composition of claim 3 wherein said composition is free of alcohol.

8. A composition comprising:

a liquid hydrocarbon base fuel;

an anti-knock enhancing amount of the compound of the formula:

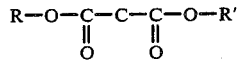

wherein R and R' are the same or different $C_1$ to $C_{10}$ alkyl radical and wherein said composition is essentially free of organo-lead and organo-manganese compounds.

9. A composition comprising a major amount of a liquid hydrocarbon base fuel and an anti-knock enhancing amount of a compound of the formula:

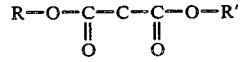

wherein R and R' are the same or different $C_1$ to $C_{10}$ alkyl, alkenyl or alkynyl radical.

10. The composition of claim 1 wherein R and R' are the same or different and are either methyl or ethyl radicals.

* * * * *